US008967208B2

(12) United States Patent
Bridges et al.

(10) Patent No.: US 8,967,208 B2
(45) Date of Patent: Mar. 3, 2015

(54) SECURED SYSTEM FOR FIRE SUPPRESSION REFILL AND RECOVERY

(75) Inventors: George A. Bridges, Laurel, MS (US); Pamela Sue Bridges, Laurel, MS (US)

(73) Assignee: International Fire & Safety, Inc., Laurel, MS (US)

( * ) Notice: Subject to any disclaimer, the term of this patent is extended or adjusted under 35 U.S.C. 154(b) by 1043 days.

(21) Appl. No.: 13/012,342

(22) Filed: Jan. 24, 2011

(65) Prior Publication Data

US 2012/0186691 A1 Jul. 26, 2012

(51) Int. Cl.
*B65B 31/00* (2006.01)
*A62C 35/15* (2006.01)

(52) U.S. Cl.
CPC ..... *A62C 35/15* (2013.01)
USPC ..... 141/20; 141/3; 141/94; 141/98

(58) Field of Classification Search
CPC ..... A62C 35/02; A62C 35/11; A62C 35/13; A62C 35/15
USPC ..... 141/2, 3, 18, 20, 65, 94, 95, 98; 169/30
See application file for complete search history.

(56) References Cited

U.S. PATENT DOCUMENTS

| | | | | | |
|---|---|---|---|---|---|
| 2,780,899 | A * | 2/1957 | Benson et al. | 53/268 |
| 3,875,980 | A * | 4/1975 | Getz | 141/83 |
| 3,942,561 | A * | 3/1976 | Stoeffler | 141/67 |
| 3,951,185 | A * | 4/1976 | Bower et al. | 141/1 |
| 4,053,001 | A * | 10/1977 | Healey et al. | 141/2 |
| 4,121,632 | A * | 10/1978 | Zehr | 141/59 |
| 4,182,384 | A * | 1/1980 | Zehr | 141/7 |
| 4,245,679 | A * | 1/1981 | Self | 141/2 |
| 4,337,803 | A * | 7/1982 | Monte | 141/2 |
| 4,687,032 | A * | 8/1987 | Self | 141/81 |
| 5,730,193 | A * | 3/1998 | Sparks et al. | 141/51 |
| 8,225,825 | B1 * | 7/2012 | Wilhelmi | 141/247 |
| 2009/0032272 | A1 * | 2/2009 | Duncan | 169/85 |

* cited by examiner

*Primary Examiner* — Timothy L Maust
(74) *Attorney, Agent, or Firm* — Blank Rome LLP

(57) ABSTRACT

A secured system for fire suppression refill and recovery and a method for using such system. Operation of the system involves the refilling of an extinguisher tank with matter from a storage tank, the recovery of matter from an extinguisher tank to a storage tank, the cleansing of matter within a tank, and the purging of matter from a tank. The system includes a secure recovery unit, secure tank units, and equipment for connecting the recovery unit to the tank units. The system is configured such that, during its operation, safety and security risks commonly associated with the transfer of matter to and from extinguisher tanks are greatly reduced.

17 Claims, 3 Drawing Sheets

SECURED SYSTEM FOR FIRE SUPPRESSION REFILL AND RECOVERY

BACKGROUND OF THE INVENTION

This invention relates to a secure system for refilling and recovering the contents of pressurized fire extinguisher tanks.

The purpose of a pressurized fire extinguisher tank is to enable its user to suppress a fire from a safe distance. However, serious security and safety risks may be associated with the use of such pressurized tanks. These risks are heightened in sensitive locations such as airports, military and other government installations, and chemical and ammunition storage sites.

Pressurized tanks can cause significant harm to both people and infrastructure when the tanks are deployed, used, or secured improperly. The potential dangers associated with pressurized tanks include explosions and the expulsion of harmful material into the atmosphere surrounding the tanks. Furthermore, pressurized tanks can become highly destructive weapons when filled with harmful biological or chemical agents. A compromised tank, even when used inadvertently, has the potential to cause a catastrophic occurrence.

Several scenarios exemplify ways by which the security of a pressurized extinguisher tank might be compromised. For example, a tank that is deployed and ready for use might be covertly removed, refilled with an unauthorized agent, and then put back into place. A tank being transported from a filling station to its place of use might be diverted to an intermediate location, tampered with, and then redeployed to its designated place of use. Prior to refill, a tank might be fitted with an unauthorized fitting, allowing for the introduction of an unauthorized agent into the tank at any time. A tank might be lined or prefilled with a token amount of an unauthorized agent such that when an authorized agent is added, the tank content might become explosive, unstable, or harmful upon dispersal. A deployed tank might be replaced by a visually identical tank containing an unauthorized agent. A tank compromised with an unauthorized agent might be taken to the recovery unit for recovery. A structurally compromised tank, for example, a clone tank with a thin wall, might contain a harmful agent prior to being transported to the refill station.

The purpose of this invention is to mitigate the aforementioned dangers by minimizing the potential for both accidental and intentional modification of fire extinguisher tanks and storage tanks, by minimizing the potential for unauthorized access to fire suppressor refill and recovery systems, and by enhancing the forensic information that is available in relation to the conveyance of content into and out of fire extinguisher tanks.

Finally, many materials and procedures utilized in the field of fire suppression are subject to regulation by the EPA. A purpose of this invention is to provide a system by which compliance with EPA regulations is simplified and ensured.

SUMMARY OF THE INVENTION

This invention encompasses an environmentally friendly secured system for fire suppression refill and recovery, and a method for making and using such a system. The invention improves safety and security of a fire suppression refill recovery system by preventing or minimizing both accidental and intentional hazards, preventing unauthorized access and operation of the system, providing for intensive traceable documentation and record keeping, and preventing tampering with the system. The invention minimizes or eliminates human error, ensures its proper operation with validation and documentation, and enhances accountability and forensic traceability while maintaining simplicity of operation.

The invention includes a secure recovery unit that serves to recover a fire extinguishing agent from a fire extinguisher tank to a storage tank, to fill or refill a fire extinguisher tank with a fire extinguishing agent from a storage tank, and to pressurize a filled fire extinguisher tank with a pressurizing gas. Furthermore, the recovery unit may serve to cleanse the fire extinguishing agent contained in a tank, and to purge a tank of its contents. The invention also includes a secure tank unit that may be used as a fire extinguisher tank or as a storage tank for a fire extinguishing agent. Finally, this invention includes a secured system for fire suppression refill and recovery involving a secure recovery unit and secure tank units, as well as a method for using the secured system.

The recovery unit is used to recover a fire extinguishing agent from a fire extinguisher tank into a storage tank. The recovery unit is also used to fill or refill and pressurize a fire extinguisher tank containing a fire extinguishing agent.

The recovery unit may have a unique identification code associated specifically with the recovery unit.

The recovery unit may include a rack which may include designated locations for each of a fire extinguisher tank, a storage tank, a pressurizing tank, a sensor/verification tank, and a tank for contaminated agent found in the process. The rack may be rotatable and may be locked in position. The rack may be clearly labeled with a recovery sign and a refill sign. The recovery unit may be configured to detect its desired operating mode based on the position of the cylinder in the rack. When content is conveyed from the fire extinguisher tank to the storage tank, the fire extinguisher tank is referred to as the supply tank and the storage tank is referred to as the receiver tank. Similarly, when content is conveyed from the storage tank to the fire extinguisher tank, the storage tank is referred to as the supply tank and the fire extinguisher tank is referred to as the receiver tank. Preferably, the pressurizing tank contains an inert gas, preferably nitrogen.

The recovery unit may include tank identifier devices for identifying tanks at each of the designated locations for each of the tanks included in the system. Preferably, each tank identifier device is a non-detachable barcode scanner or RFID scanner. Each of the designated locations may be shrouded or enclosed such that a tank must be in position before its associated tank identifier device will activate. The recovery unit may be capable of identifying a tank in a designated location regardless of the orientation of the tank. Furthermore, the recovery unit may be capable of interrogating a tank unit. Interrogation of a tank unit may include verification of tank identification information, detection of a damaged tamper fuse, and verification of the electrical signature of the tank via electrodes in the tank head.

The recovery unit may include weight monitors, preferably load cells or platform scales, for monitoring the weight of each tank throughout the operation of the recovery unit. Such weight information may be used to track and inventory the content being conveyed during the operation of the recovery unit.

The recovery unit may include a user identification system for identifying the user of the recovery unit. For example, the user identification system may include a fingerprint scanner and a fingerprint authentication system. The user identification system may also include a camera for capturing a still image of the user, a device for accepting a personal identification number (PIN) from the user, and systems for authenticating a user image and PIN, alone or in combination.

The recovery unit may be configured to verify that the user and all tanks involved in the operation of the recovery unit are authorized. Once verification is complete, the recovery unit may be capable of performing an automated process by which the recovery unit evacuates vapor from the supply tank, conveys the content of the supply tank into the receiver tank, and pressurizes the receiver tank with gas from the pressurizing tank. Additionally, the recovery unit may capable of purging a tank of its content. The recovery unit may be configured such that during the operation of the recovery unit, sensors built in to the recovery unit validate the content being conveyed, and the recovery unit issues warning signals as warranted and initiates a system shutdown if appropriate.

The recovery unit may include a hydraulic circuit that incorporates functionalities including the filling and recovery of tank content, the cleansing of contaminated content within a tank, and the purging of content from a tank. The filling operation involves the conveyance of content from the storage tank to the extinguisher tank and the pressurization of the extinguisher tank with a pressurizing gas from the pressurizing tank. The recovery operation involves the conveyance of content from the extinguisher tank to the storage tank. The cleansing operation involves circulating the content of a tank through a filtration system, preferably including a moisture filter and a particulate filter. The purging operation involves the expulsion of residual matters from the system into a contaminant tank or into the atmosphere.

The recovery unit may include a mechanical system that is designed to accommodate the installment of various sensors, indicators, and safety components.

The recovery unit may include an electrical system that encompasses the electrical hardware that controls and monitors the various components of the hydraulic circuit, interfaces to the sensors, interfaces to the user, and data collection facility and communication.

The recovery unit may include a sensor suite with sensors to monitor turbidity, moisture, pressure, temperature, image, power-good, watchdog, identification, signature, proximity, load cells, flow rate, density, reverse polarity, and safety. The recovery unit may include a control system that incorporates a feedback system for stable and accurate operations, and an embedded computer system with data storage and communication capabilities.

The recovery unit may be configured such that all information generated and collected by the recovery unit is stored in a non-volatile data storage system. Such information may include the recovery unit identification number, user identification information, tank identification information, periodic weight information, sensor status, process start date and time, and process end date and time.

The recovery unit may include extended features such as a wired or wireless network connection that enables the recovery unit to be centrally controlled or administered, a security camera for monitoring activity in the vicinity of the recovery unit, and a two-way communication system for live communication between the user and a central console.

The recovery unit may include a confirmation system to validate that the recovery unit has been inspected. The confirmation system may be a sticker with an expiration date that is affixed on the recovery unit as validation that the recovery unit has been inspected. The sticker should include a pattern that is viewable only by a computer, or by a human using a special visualization tool such as a special flashlight or special polarizing lens.

The tank unit may be one of a proper classification as set forth by standards such as ASTM and MILL. The tank unit may include an embedded identification system that is robust and not easy to duplicate. The embedded identification system may include tank identification information such as manufacture code, serial number, classification, date of manufacture, and capacity.

The tank unit may include a tank and a tank head. Preferably, the tank head is a shroud made of a durable composite material that fits tightly to the top portion of the tank. The tank head should be replaceable. However, once installed, the tank head should not be removable without alteration of the detectable integrity of both the tank and the tank head. Embedded into the tank head should be the tank identification information, a tamper fuse indicator, at least one electrode, a set of tank and hose fittings, and a robust electrical connector system. The tamper fuse should be damaged whenever the tank head system is altered. The electrode should be in electrical contact with the tank and should be capable of being used to obtain the electrical signature of the tank.

The tank unit may include at least one tamper resistance measure designed to minimize the potential for the introduction of unauthorized material into the tank.

The tamper resistance measure may include a precise coating system applied to the tank in such a way that the tank exhibits specific electrical and magnetic characteristics. In this case, tamper detection can be achieved by verifying the electrical or magnetic permeability of the tank.

The tamper resistance measure may include a capacitive lining applied to the inside the tank during manufacturing and an electrical test point on the exterior of the tank for verification. A tampering method that involves drilling or cutting the tank will change the capacitance of the tank and will be detected upon verification.

The tamper resistance measure may include the strategic placing of the embedded identification system on the tank such that tampering with the tank will likely result in the embedded identification system becoming damaged or inoperable, thus preventing the tank from being validated by the recovery unit.

The tamper resistance measure may include an embedded pattern painted on the tank such that the pattern is viewable only by a computer, or by a human using a special visualization tool such as a special flashlight or special polarizing lens. This tamper resistance measure requires an inspection system that is either standalone or integrated with the recovery unit.

The tamper resistance measure may include a specific electrical signature established in the tank at the time the tank is manufactured. In this case, tamper detection can be achieved by verifying the electrical signature of the tank via electrodes in the tank head.

The tank unit may include fittings which constitute the pathway by which content enters and exits the tank. Fittings should be secured to prevent tampering. Fittings may be secured by way of a lock-out/tag-out protocol. In the case of a lock-out/tag-out protocol, all fittings and the tank should have integrated stubs with openings to facilitate the weaving of a tag wire. A breakable wire with a tag, preferably brightly colored, should be weaved through the openings in the stubs to tie and secure every linkage between a fitting and the tank, and between fittings. Termination of the tag wire should be performed with a traceable tool, such that the tool leaves unique identification information on the tag. The weaving method should be performed in one particular standard pattern so that a non-standard weaving pattern or a hasty weaving pattern may be an indication of tampering. Tampering may also be indicated by a broken or cut tag. When a deployed tank is used for extinguishing a fire, the action of pulling the hose will naturally break the tag. In this case, the tag should be replaced and the tank refilled and inspected. The disposal of a used tag in this case should be performed by a secure method to prevent counterfeiting of the tag.

The tank unit may include an intermediate interconnect fitting. The purpose of the intermediate interconnect fitting is to prevent the tank from being filled by a system other than a designated recovery unit. The intermediate interconnect fitting should be installed between the tank and a quick-connect fitting, and should possess an electronic signature. The intermediate interconnect fitting should be made to have a stub with an opening for lock-out/tag-out, and an electronic valve that is normally closed and can open only when power from a hose harness of a recovery unit is applied to the intermediate interconnect fitting and a match in signature is detected. The intermediate interconnect fitting should be a custom made device, uniquely manufactured according to a standard military protocol.

The tank unit may include a confirmation system to validate that the tank unit has been inspected. The confirmation system may be a sticker with an expiration date that is affixed on the tank as validation that the tank has been inspected. The sticker should include a pattern that is viewable only by a computer, or by a human using a special visualization tool such as a special flashlight or special polarizing lens.

The secured system for fire suppression refill and recovery may include a recovery unit, a tank unit, a tank hat, and a set of connector harnesses. Preferably, the recovery unit includes the majority of the system components, including the control electronics, valves, pump, sensors, power supply, and fittings for the connector harnesses. The tank hat is a subsystem that should be mounted onto the tank head of the tank unit. The tank hat may includes fitting for connection to the tank unit via the tank head, a tank identifier system, an electro-mechanical relay circuit, indicators, and a wire connector. Components of the tank hat may verify data for security purposes. The connector harness may include hoses, cables, connectors, and hose fittings. The connector harness connects the recovery unit to the tank hat.

The secured system for fire suppression refill and recovery includes mechanical, electrical hardware design, software algorithm, and operational protocols for both security and EPA accountability. The secured system for fire suppression refill and recovery provides for the production and storage of all information if required by the EPA to ensure compliance with EPA regulations. The system provides for complete records of who, where, what, and when; and will be done electronically as the refill, recovery, or maintenance is being performed. A record will be produced and stored in the database for purposes of reporting to EPA, and other agencies that may require it, any and all agents that have been recovered, discharged, or recharged and put back into use. The system will produce the records as a user operates the system and, if needed, the records will be kept in secret from the user performing the operation.

Generally, an operation cycle of the invention includes the steps of: a user loading a supply tank, receiver tank, and pressurizing tank in designated locations of the recovery unit, and ensuring that all proper connections between tank units and the recovery unit have been established; the recovery unit accepting and authenticating tank identification information from the tank units; the recovery unit accepting and authenticating user identification information from the user; the user specifying the desired operation mode from refill, recovery, cleanse, and purge; and the recovery unit conveying content between the tank units in accordance with the specified operation mode.

The secured system for fire suppression refill and recovery may be such that it is appropriate for use in a confinement area in which it has been established that tank units must remain within a specified perimeter. Multiple access paths, gates, and access points of the confinement area may have, for example, RFID scanners strategically positioned such that a tank unit may be detected when it is in the proximity of a scanner. A central monitoring system may map the movement of each tank by analyzing the time sequence of each detected tank.

DETAILED DESCRIPTION OF THE PREFERRED EMBODIMENTS

Figure 1:
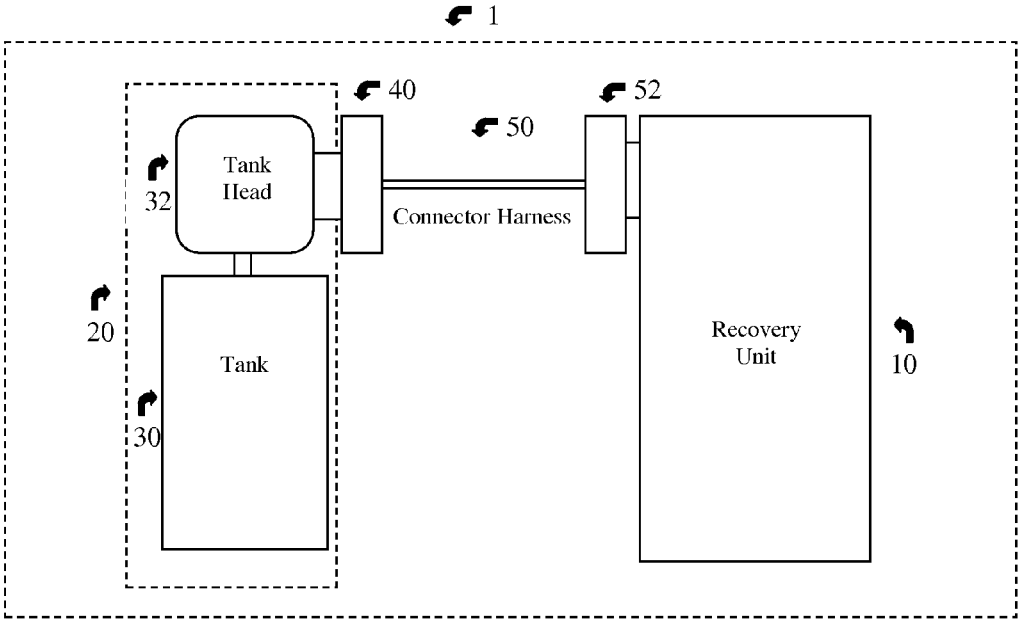
FIG. 1 shows a functional diagram of the interfaces of the secure system for fire suppressor refill and recovery.

FIG. 1 shows a functional diagram of an embodiment of the secured system for fire suppression refill and recovery 1. The system 1 includes a recovery unit 10 and a tank unit 20. The recovery unit 10 contains the majority of the system components, including control electronics, valves, pump, sensors, power supply, and fittings 52 for the connector harness 50. The tank unit 20 consists of a tank 30 and a tank head 32 fitted tightly to the top portion of the tank 30. The connector harness 50 serves as the interface between the recovery unit 10 and the tank unit 20. The connector harness 50 includes hoses, cables, connectors and hose fittings. The tank unit 20 connects to the connector harness 50 via the tank hat 40. The tank hat 40 is a subsystem that is mounted onto the tank head 32. The tank hat 40 includes fittings for connection to the tank unit 20 via the tank head 32, a tank identifier such as an RFID or barcode scanner, an electro-mechanical relay circuit, indicators, and a wire connector. Only one tank unit 20 is shown in FIG. 1. However, during operation of the invention, the system 1 may include multiple tank units, which may include a storage tank, an extinguisher tank, a pressurizing tank, a sensor/verification tank, and a tank for contaminated agent found in the process. During operation of the invention, each tank unit is connected to the recovery unit 10 in a manner similar to the tank unit 20 shown in FIG. 1.

Figure 2:
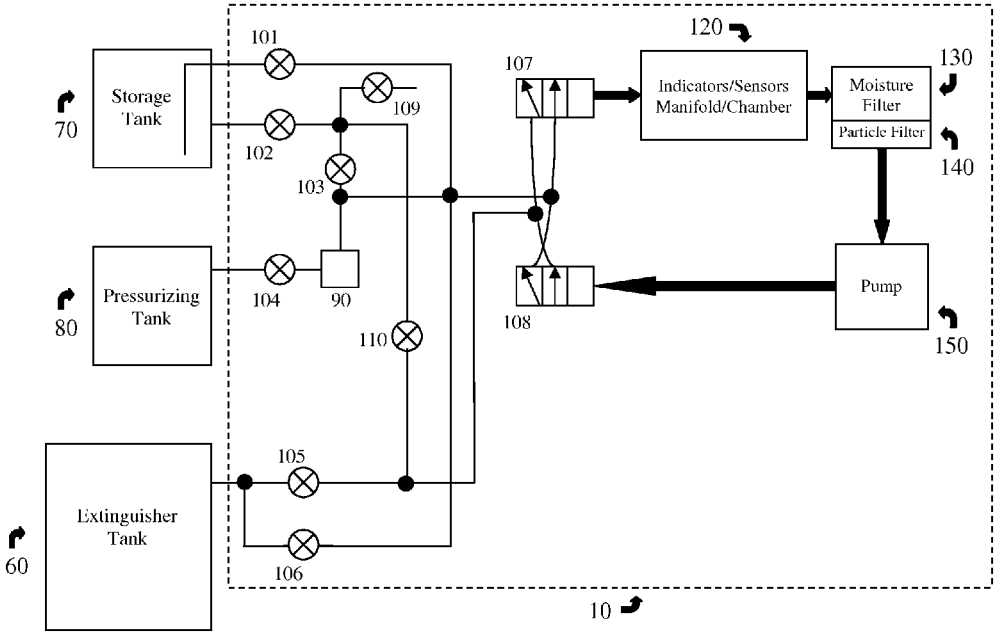
FIG. 2 shows a hydraulic circuit diagram of the recovery unit.

FIG. 2 shows a hydraulic circuit diagram of an embodiment the recovery unit 10. The refill operation of the recovery unit 10 involves the transfer of content from the storage tank 70 to the extinguisher tank 60, and the pressurization of the extinguisher tank 60 with gas from the pressurizing tank 80. Preferably, the transferred content is a chemical agent of the type generally used for fire suppression, and the pressurizing gas is an inert gas, preferably nitrogen.

The recovery operation of the recovery unit 10 involves the transfer of content from the extinguisher tank 60 to the storage tank 70. Preferably, the transferred content is a chemical agent of the type generally used for fire suppression, which may include multi-purpose dry chemical, carbon dioxide, fire retardant foam, etc.

The cleanse operation of the recovery unit 10 involves recirculating the content of the storage tank 70 through a set of filters, including a moisture filter 130 and a particle filter 140, thus purifying non-virgin content contained in the storage tank. The purified content may then be reused to refill an extinguisher tank. This way, waste is minimized.

The purging operation of the recovery unit 10 involves the expulsion of residual matters from the system into a containment tank or vented to the atmosphere. If vented to the atmosphere, the matter may be decontaminated before being released. The purged content may also be purified and reused in a manner similar to the cleanse operation.

The conveyance content throughout the system 1 is controlled by a pump 150, a pressure regulator 90, and a set of valves 101-110. Further control and monitor functions are performed by a hydraulic subcircuit 120. The hydraulic subcircuit 120 includes sensors to monitor material passing through the system 1, indicators, a hydraulic manifold, and a chamber.

Figure 3:
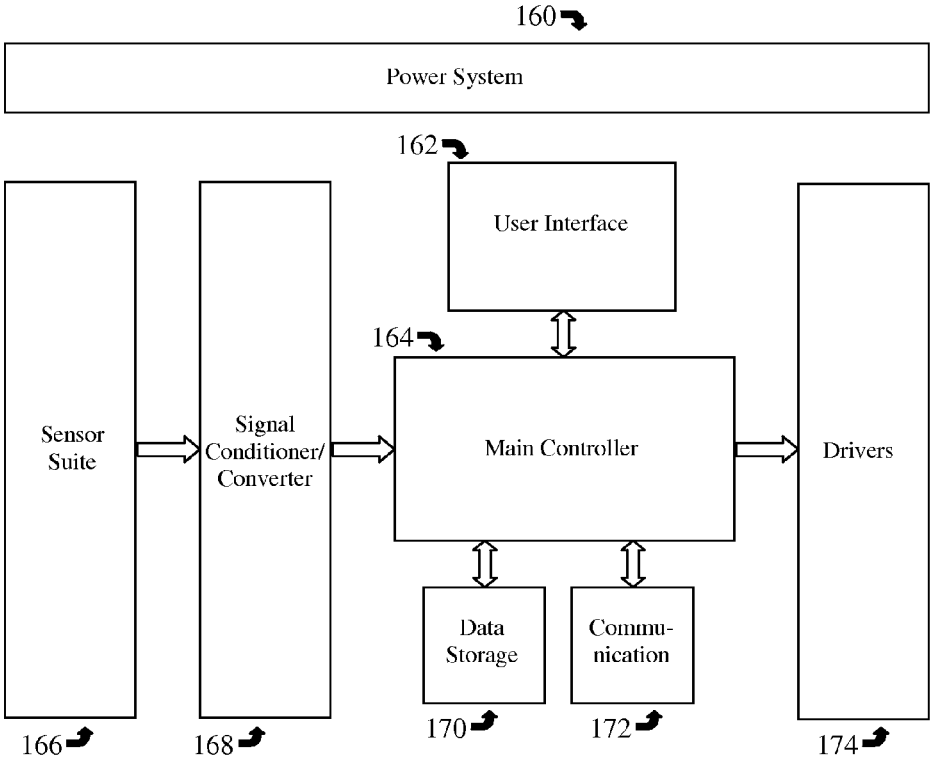
FIG. 3 shows a block diagram of the electrical system of the recovery unit.

FIG. 3 shows a block diagram of the electrical system of an embodiment of the recovery unit 10. The electrical system of the recovery unit 10 includes a power system 160, a user interface 162, a main controller 164, a sensor suite 166, a signal conditioner/converter 168, a data storage device 170, a communication device 172, and a set of drivers 174. The sensor suite 166 includes sensors to monitor turbidity, moisture, pressure, temperature, image, power-good, watchdog, identification, signature, proximity, load cells, flow rate, density, reverse polarity, and safety.

The conglomeration of sensors in the sensor suite 166 may function to enable automated operation of all the procedures described in the hydraulic circuit of the recovery unit. The integrity of the integrity of the system 1 may be monitored by various hardware and software components. For example, a power-good sensor may monitor the correct electrical power application in the system. A watchdog sensor may ensure that the system does not perform any step of a procedure in an indefinite amount of time. Operation of the recovery unit 10 may be preceded by an authorization process that includes multiple levels of user identification and connection verification. The user identification process may include image collection and biometric validation, while the connection verification may include identification of the tanks.

The operation of the system 1 and the parameters of agent may be monitored and recorded automatically. The operation and parameters monitoring involved in the filling process may include: pressure and vacuum, monitored by pressure sensors; purity of the agent, monitored by moisture and turbidity sensors; density of the liquid, validated by a density sensor; amount and rate of flow, monitored by a weight sensor and flow sensor, respectively. The sensor suite 166 may enable the system to operate automatically and safely.

The sequence of operation of the system may be automated. Furthermore, in the case of failure, the system may shut down and manual operation may be conducted. The system may provide forensic information including reports that may be generated from data collected.

What is claimed is:

1. A secured system for fire suppression refill and recovery, comprising:

a recovery unit comprising: a unique identification code associated with the recovery unit, a rack with designated locations for a receiver tank and a supply tank, a tank identifier device for identifying tanks placed in the designated locations, a weight monitor for monitoring weights of the tanks placed in the designated locations, and a user identification system for identifying a user of the recovery unit;

at least one tank unit comprising: a tank, a tank head having an embedded identification system, and at least one tamper resistance measure; and a connector harness system to provide an interface between the recovery unit and the tank unit.

2. The secured system for fire suppression refill and recovery according to claim 1, wherein the connector harness system comprises a tank hat.

3. The secured system for fire suppression refill and recovery according to claim 1, further comprising a means for validating the composition of content being conveyed between a receiver tank and a supply tank.

4. The secured system for fire suppression refill and recovery according to claim 1, further comprising a network connection allowing the recovery unit to be centrally controlled and administered.

5. The secured system for fire suppression refill and recovery according to claim 1, further comprising a security camera for monitoring activity in a vicinity of the recovery unit.

6. The secured system for fire suppression refill and recovery according to claim 1, further comprising a two-way communication system for live communication between the user and a central console.

7. The secured system for fire suppression refill and recovery according to claim 1, further comprising at least one sensor to monitor at least one of turbidity, moisture, pressure, temperature, power-good, watchdog, ID, signature, proximity, load cells, flow rate, density, reverse polarity, and safety.

8. The secured system for fire suppression refill and recovery according to claim 1, wherein said embedded identification system comprises at least one of a barcode and a RFID.

9. The secured system for fire suppression refill and recovery according to claim 1, wherein one tamper resistance measure comprises a precise coating system applied to the tank in such a way as to provide the tank with specific electrical and magnetic characteristics.

10. The secured system for fire suppression refill and recovery according to claim 1, wherein one tamper resistance measure comprises an internal capacitive lining applied to the tank, and further comprises an external electrical test point by which a capacitance of the tank may be measured.

11. The secured system for fire suppression refill and recovery according to claim 1, wherein one tamper resistance measure comprises the placing of the embedded identification system in a location such that tampering with the tank is likely to result in the embedded identification system becoming damaged or inoperable.

12. The secured system for fire suppression refill and recovery according to claim 1, wherein one tamper resistance measure comprises an embedded pattern painted on the tank, wherein said embedded pattern is viewable only by a computer, or by a human using a special visualization tool.

13. The secured system for fire suppression refill and recovery according to claim 1, wherein the tank unit further comprises a lock-out / tag-out protocol, including:

fittings attached or mounted onto the tank, said fittings having one or more fitting stubs integrated with one or more tank stubs, said fitting stubs and tank stubs comprising openings to facilitate the weaving of a tag wire; and a breakable tag wire with a tag, said tag wire being weaved through the openings to tie and secure every linkage between each fitting and the tank, and each linkage between fittings, wherein termination of the tag wire is performed with a traceable tool, said tool leaving a unique identifier on the tag, wherein the tag wire is weaved in a particular standard pattern, such that a non-standard weaving pattern can be an indication of tampering, and wherein a broken or cut tag can be an indication of tampering.

14. The secured system for fire suppression refill and recovery according to claim 1, wherein the tank unit further comprises an intermediate interconnect fitting with an electronic signature, said intermediate interconnect fitting having an electronic valve that will open only when power from a recovery unit is applied to the valve and a match in signature is detected between the recovery unit and the intermediate interconnect fitting.

15. The secured system for fire suppression refill and recovery according to claim 14, wherein the intermediate interconnect unit further comprises a stub with an opening to facilitate a lock-out / tag-out protocol.

16. The secured system for fire suppression refill and recovery according to claim 1, wherein the tank unit further comprises a confirmation system to validate that the tank unit has been inspected.

17. The secured system for fire suppression refill and recovery according to claim 16, wherein the confirmation system comprises a pattern, wherein said pattern is viewable only by a computer, or by a human using a special visualization tool.

* * * * *